US006056645A

United States Patent [19]

Servatius

[11] Patent Number: 6,056,645

[45] Date of Patent: May 2, 2000

[54] PORTABLE PRACTICE PUTTING GREEN

[76] Inventor: Richard James Servatius, 4830 43rd St. NW., Washington, D.C. 20016

[21] Appl. No.: 09/159,576

[22] Filed: Sep. 24, 1998

[51] Int. Cl.[7] ..... A63B 69/36

[52] U.S. Cl. ..... 473/161; 473/162

[58] Field of Search ..... 473/160, 161, 473/162

[56] References Cited

U.S. PATENT DOCUMENTS

| | | |
|---|---|---|
| 3,690,673 | 9/1972 | Occhipinti . |
| 3,892,412 | 7/1975 | Koo . |
| 5,441,265 | 8/1995 | Codlin . |
| 5,655,971 | 8/1997 | Wayne . |

FOREIGN PATENT DOCUMENTS

| | | | |
|---|---|---|---|
| 2072022 | 9/1981 | United Kingdom | 273/176 H |

*Primary Examiner*—Mark S. Graham
*Attorney, Agent, or Firm*—Terrance L. Siemens

[57] ABSTRACT

A portable practice putting green comprising a first flexible layer. A second flexible layer is molded onto the first flexible layer to form a plurality of inflatable chambers therebetween. A third flexible layer is bonded onto the second flexible layer. The third flexible layer has a hole to receive a golf ball putted therein. The first flexible layer, second flexible layer and third flexible layer can be rolled up together to be conveniently placed into storage and safely transported.

1 Claim, 2 Drawing Sheets

PORTABLE PRACTICE PUTTING GREEN

BACKGROUND OF THE INVENTION

1. Field of the Invention

The present invention relates generally to golf putting aids. More particularly, the invention comprises a portable practice putting green which is in combination a flexible base sheet and a flexible cover sheet molded together to form sealed inflatable chambers therebetween. A flexible artificial grass sheet having a putting cup is attached thereon. When not in use the portable practice putting green can be rolled up for storage or transportation.

2. Description of the Prior Art

Attempts have been made in the prior art to devise golf putting aids which are permanent structures having variable contours. This allows golfers to practice driving and putting golf balls upon these permanent structures which are placed upon the floor.

Golf putting aids are shown in U.S. Pat. No. 3,690,673, issued to Peter W. Occhipinti on Sep. 12, 1972, U.S. Pat. No. 3,892,412, issued to Bonny B. Koo on Jul. 1, 1975, U.S. Pat. No. 5,441,265, issued to Kenneth H. Codlin on Aug. 15, 1995, and U.S. Pat. No. 5,655,971, issued to Ronald Wayne on Aug. 12, 1997.

U.S. Pat. No. 3,690,673 to Occhipinti shows a selectively contourable putting green. It is a golf putting green simulator which includes an enclosed support member having a defined configuration over which synthetic grass is extended to provide a putting surface.

U.S. Pat. No. 3,892,412 to Koo shows a putting practice green. It consists of a base, a plurality of inflatable bags and a top sheet of simulated grass surface. When the bags are inflated the top sheet is provided with selected undulations.

U.S. Pat. No. 5,441,265 to Codlin shows a practice putting green with variable contours. It is an apparatus primarily developed for the purpose of varying the contours of a practice putting surface for improving a player's capabilities.

U.S. Pat. No. 5,655,971 to Wayne shows a variable contour practice putting green. The device is provided with selectively variable contours which allows a great variation in the shape of the contours.

In each one of these prior art inventions, the golf putting aids are permanent structures when assembled and placed upon the floor. By contrast, the present invention being a portable practice putting green has the ability to be rolled up and conveniently placed into storage or transported.

None of the above inventions and patents, taken either singly or in combination, is seen to describe the instant invention as claimed.

SUMMARY OF THE INVENTION

The present invention is a portable practice putting green consisting of a flexible base sheet and a flexible cover sheet molded together to form a plurality of sealed inflatable chambers therebetween which can be selectively inflated. A flexible artificial grass sheet having a putting cup is attached to the cover sheet, so that a golfer can practice putting. When not in use, it can be rolled up and stored for future use.

Accordingly, it is a principal object of the invention to provide a portable practice putting green that will overcome the shortcomings of the prior art devices.

Another object of the invention is to provide a portable practice putting green that consists of a flexible base sheet and a flexible cover sheet molded together to form a plurality of sealed inflatable chambers therebetween which can be selectively inflated.

An additional object of the invention is to provide a portable practice putting green in which a flexible artificial grass sheet having a putting cup is attached to the cover sheet, whereby when not in use can be rolled up and stored for use at a later time.

A further object of the invention is to provide a portable practice putting green that is simple and easy to use.

A still further object of the invention is to provide a portable practice putting green that is economical in cost to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
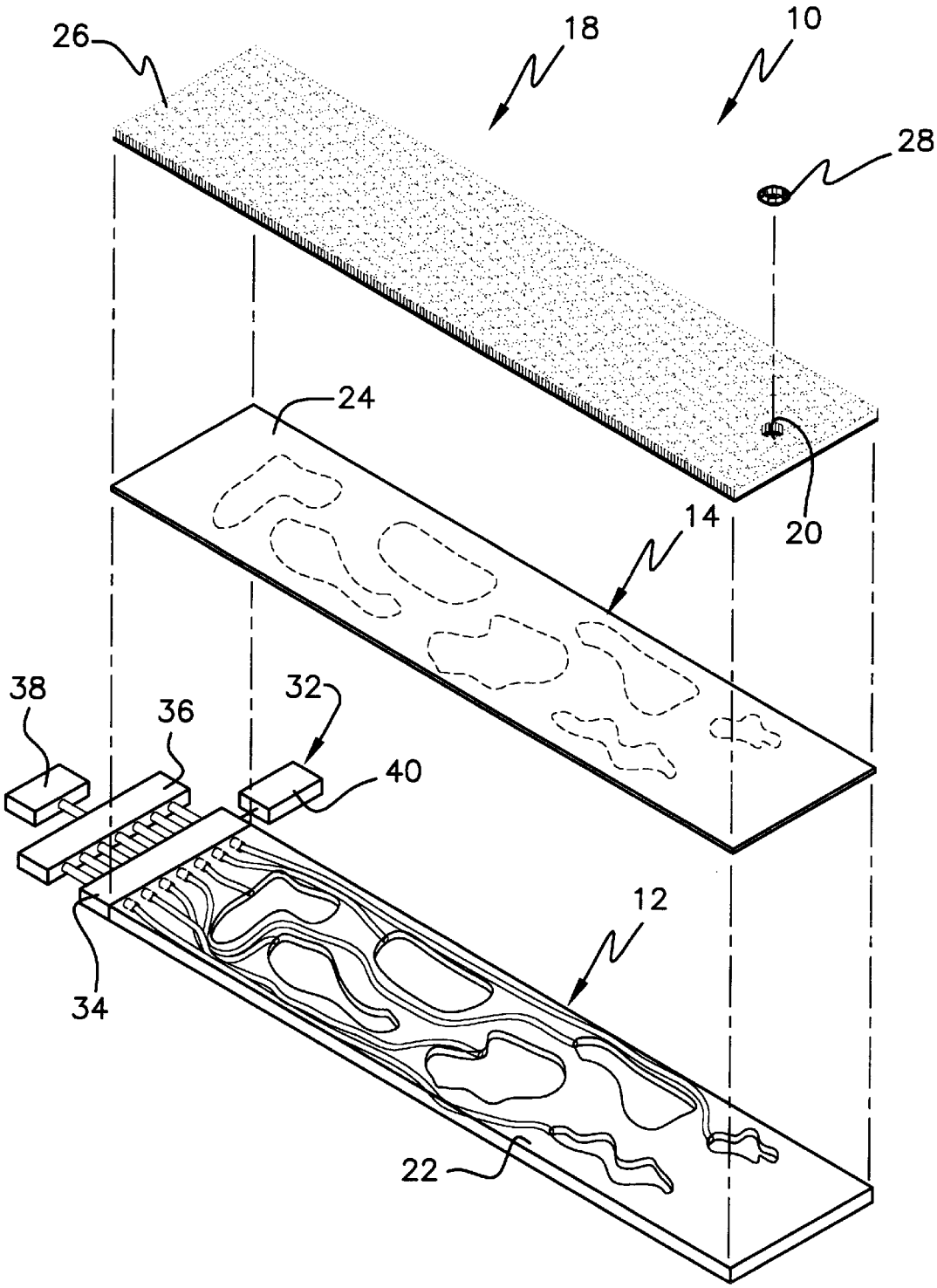
FIG. 1 is an exploded perspective view of the present invention.
Figure 2:
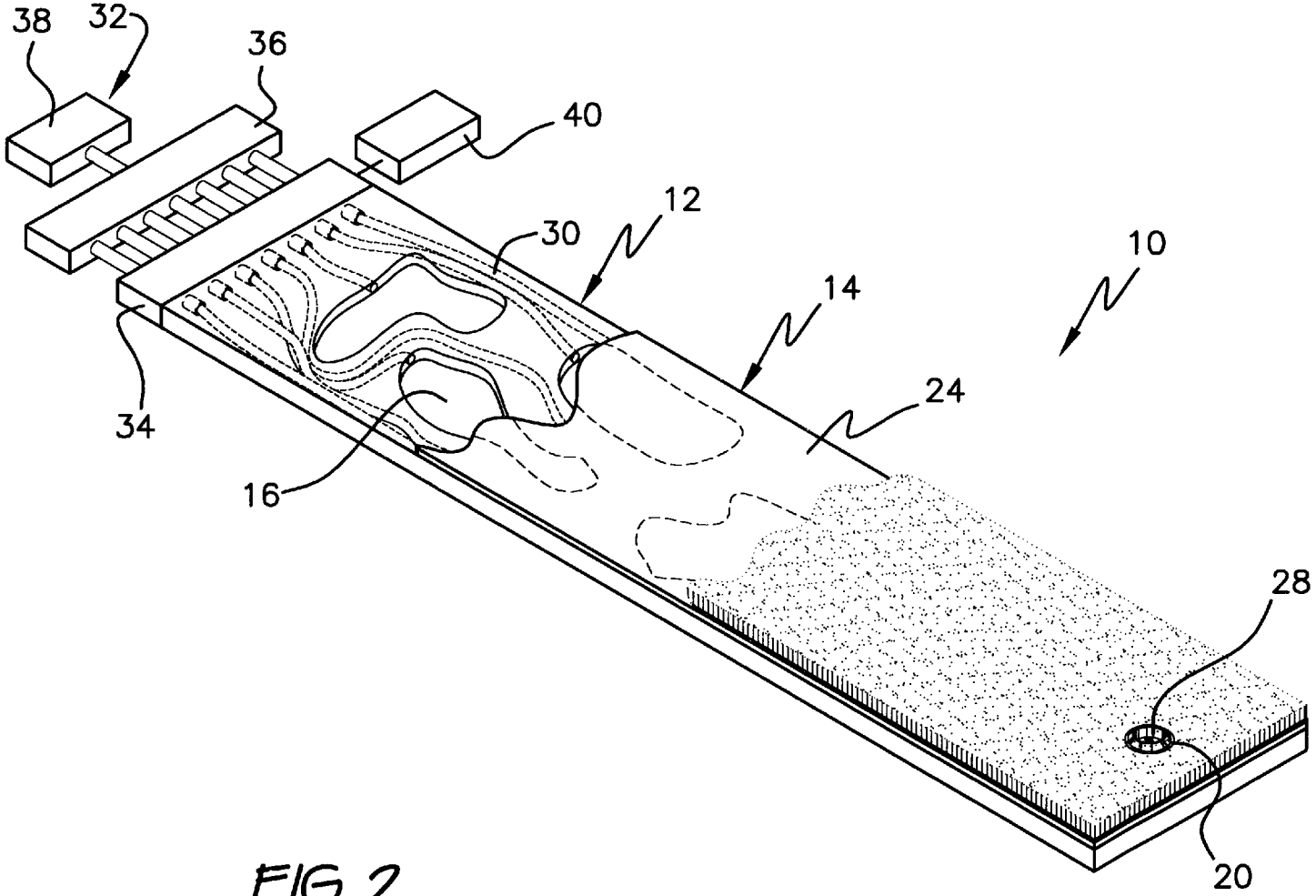
FIG. 2 is a top plan view taken in the direction of arrow 2 in FIG. 1, with the flexible artificial grass sheet broken away.

Turning now descriptively to the drawings, in which similar reference characters denote similar elements throughout the several views, FIGS. 1 and 2 illustrate the present invention being a portable practice putting green 10 comprising a first flexible layer 12. A second flexible layer 14 is molded onto first flexible layer 12 to form a plurality of inflatable chambers 16 therebetween. Obviously, this seals the two layers to form air-tight pockets therebetween. A third layer 18 is bonded onto second flexible layer 14. Third flexible layer 18 has a hole 20 to receive a golf ball putted therein. First flexible layer 12, second flexible layer 14 and third flexible layer 18 can be rolled up together to be conveniently placed into storage and safely transported.

First flexible layer 12 is a rectangular base sheet 22. Second flexible layer 14 is a rectangular cover sheet 24 being of a size equal to that of first flexible layer 12. Third flexible layer 18 is a rectangular artificial grass sheet 26 being of a size equal to that of first flexible layer 12 and second flexible layer 14.

A putting cup 28 is inserted into hole 20 to act as a receptacle to retain the golf ball putted therein. Each inflatable chamber 16 is irregularly shaped and includes a conduit 30 fluidly extending therefrom. An inflation means 32 is fluidly connected to all of the conduits 30 for selectively inflating chambers 16, whereby portions of third flexible layer 18 will be raised to simulate an uneven terrain. Inflation means 32 includes a value unit 34 fluidly connected to all of the conduits 30. Manifold 36 is fluidly connected to valve unit 34. An air pump 38 is fluidly connected to manifold 36. Electronic controller 40 is connected to valve unit 34 to operate valve unit 34 in a selective manner.

To use the portable practice putting green 10 a golfer simply unrolls first flexible layer 12, second flexible layer 14 and third flexible layer 18 together upon a floor or ground. The electronic controller 40 is then activated to operate the valve unit 34. Air pump 38 will supply pressurized air through manifold 36. Valve unit 34 will selectively allow inflation of the chambers 16 to simulate an uneven terrain on third flexible layer 18. A golfer can now stand upon third flexible layer 18 and putt a golf ball into putting cup 28. When the golfer is finished, chamber 16 can be deflated. First flexible layer 12, second flexible layer 14 and third flexible layer 18 can now be rolled up and stored for future use. Portable practice putting green 10 in its rolled up state can also be safely transported to another location.

It is to be understood that the present invention is not limited to the embodiments described above, but encompasses any and all embodiments within the scope of the following claims.

I claim:

1. A portable practice putting green comprising:

a first flexible layer having a first, ground contacting side and a second, upward facing side, said first flexible layer also including a plurality of irregular hollowed out sections in said second, upward facing side;

a second flexible layer attached to said second, upward facing side of said first flexible layer to create a plurality of irregular chambers, each of said plurality of irregular chambers including a conduit fluidly connected to a manifold, where said manifold is located externally of and proximate to said first flexible layer, wherein said second flexible layer is sealed to said first flexible layer to form air-tight pockets at each one of said hollowed out sections of said first flexible layer;

a third flexible layer attached to said second flexible layer and substantially completely there overlying, said third flexible layer being an artificial grass sheet having an aperture therein to receive a golf ball;

inflation means connected to said manifold, said inflation means including an air pump fluidly connected to each of said conduits within said manifold, said inflation means further including a plurality of valves, each of said valves being connected to one of said conduits within said manifold; and an electronic controller connected to said inflation means to selectively control air pressure within each of said irregular chambers; whereby increasing air pressure within selected said irregular chambers raises said third flexible layer and allows the user to simulate varied terrain on a golf course putting green and where, when not in use, said first, said second, and said third flexible layer may be rolled up to be conveniently stored.

* * * * *